United States Patent [19]

Barten

[11] Patent Number: 4,622,492

[45] Date of Patent: Nov. 11, 1986

[54] PICTURE DISPLAY PANEL

[75] Inventor: Piet G. J. Barten, Eindhoven, Netherlands

[73] Assignee: U.S. Philips Corporation, New York, N.Y.

[21] Appl. No.: 644,823

[22] Filed: Aug. 27, 1984

[30] Foreign Application Priority Data

Aug. 25, 1983 [NL] Netherlands ..... 8302966

[51] Int. Cl.[4] ..... H01J 29/02

[52] U.S. Cl. ..... 313/422; 313/610; 40/453; 40/454; 250/213 R

[58] Field of Search ..... 313/422, 517–519, 313/610; 40/454, 453; 250/213 R, 213 VT, 553, 551

[56] References Cited

U.S. PATENT DOCUMENTS

| | | | |
|---|---|---|---|
| 4,110,014 | 8/1978 | Yevick | 250/213 R |
| 4,145,633 | 3/1979 | Peters et al. | 313/422 |
| 4,255,380 | 3/1981 | Bjorkland | 40/453 |

FOREIGN PATENT DOCUMENTS

| | | | |
|---|---|---|---|
| 468492 | 12/1952 | Italy | 40/137 |
| 634945 | 2/1962 | Italy | 40/454 |
| 622919 | 5/1949 | United Kingdom | 40/454 |

*Primary Examiner*—David K. Moore
*Assistant Examiner*—M. Razavi
*Attorney, Agent, or Firm*—Paul R. Miller

[57] ABSTRACT

A picture display panel is provided having an envelope with internal reinforcement partitions formed onto a display window. The display window is provided with substantially V-shaped grooves on the outside opposite to contact surfaces with the reinforcement partitions. The reinforcement partitions thus become substantially invisible from the outside. The outermost edges of these V-shaped grooves are preferably rounded, and the picture display window surface between juxtaposed grooves may be convexly curved into cylindrical lenses to make the reinforcement partitions even more invisible.

3 Claims, 4 Drawing Figures

Figure 2:
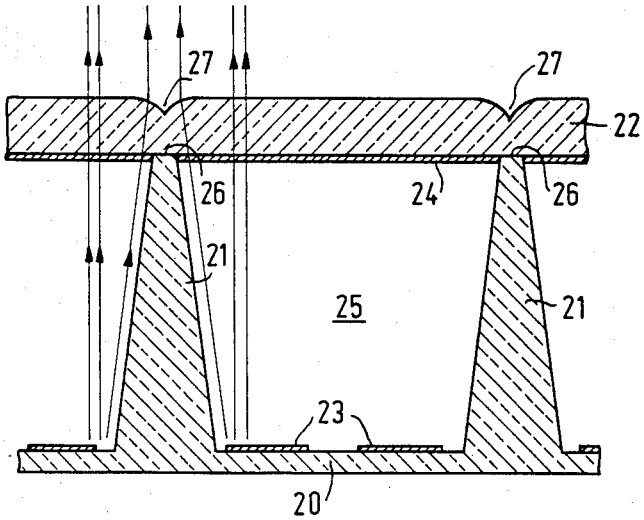

FIG.1a
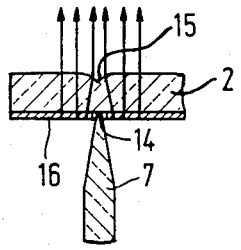
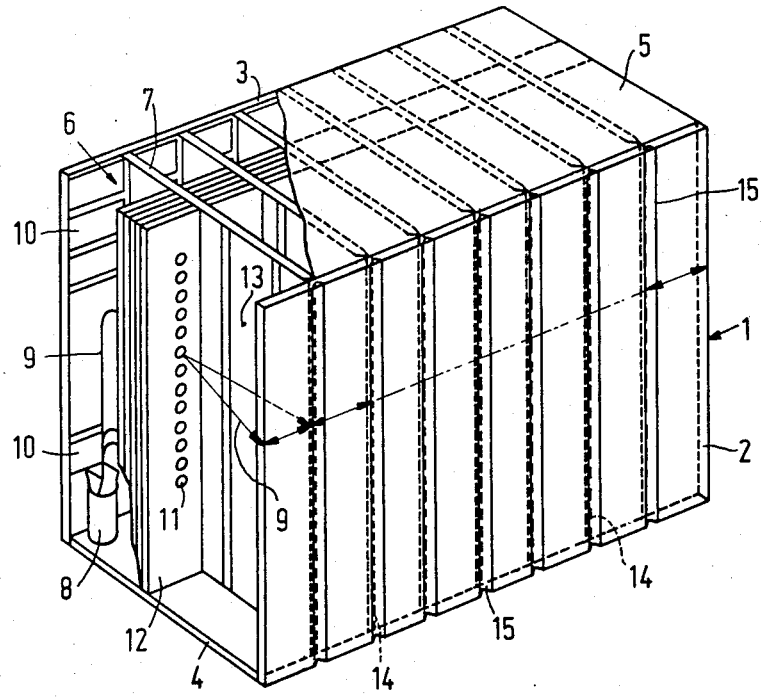
FIG.1

PICTURE DISPLAY PANEL

The invention relates to a picture display panel comprising an envelope which has a display window from which reinforcement partitions extend in the envelope at right angles to the display window.

Such a display panel may be, for example, a gas discharge panel, an electroluminescent panel or a flat cathode-ray tube.

Such a picture display panel is known from European Patent Specification No. 0,017,981 in which a gas discharge panel is described having a cathode comprising wedge-like supporting profiles. Such supporting profiles constitute reinforcement partitions for the panel on which the flat display window is supported. Such reinforcement partitions are necessary to prevent the display window from being imploded by atmospheric pressure. European Patent Application No. 82 20 1405.6 not yet laid open to public inspection, and corresponding to U.S. patent application Ser. No. 437,583 filed Oct. 29, 1982, discloses a display tube in which reinforcement partitions extend from the display window and divide the envelope into a number of modules. This tube furthermore comprises a channel plate electron multiplier.

The disadvantage of such reinforcement partitions is that, if these are at distances from each other which distances are larger than the dimensions of one picture spot. The partitions form an annoying obstacle in the visual observation of a picture and may cause inter alia moiré phenomena.

It is therefore an object of the invention to provide measures to make the reinforcement partitions substantially invisible.

For that purpose, according to the invention, a display panel comprising an envelope which has a display window from which reinforcement partitions extend in the envelope substantially at right angles to the display window, is characterized in that the outside of the display window is provided with substantially V-shaped grooves opposite to the contact surface with the partitions.

The invention is based on recognition of the fact that as a result of the provisions of such grooves opposite to the contact surface of the display window with the partitions, light also emanates from the picture display panel at the area of the grooves. This is the result of deflection of the light rays at the groove walls. The grooves are substantially V-shaped. The sharp outermost edges of the groove are preferably rounded off. Then cylinder lenses may be formed between the partitions when the display window surface between two juxtaposed grooves is curved convex. As a result an even more uniform brightness over the surface between each two partitions is obtained, so that the partitions become less and less observable for a viewer. The partitions may extend in one direction. The grooves then form a pattern of lines. However, it is also possible for the partitions to extend in other directions. The grooves may then form a raster.

Figure 3:
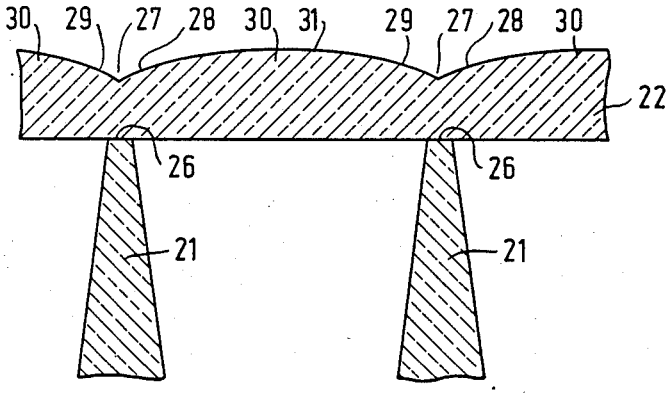

The invention will now be described in greater detail, by way of example, with reference to a drawing, in which:

FIG. 1 is an elevational view, partly broken away, of a detail of a flat display tube according to the invention, FIG. 1*a* is a partial view of a portion of FIG. 1, FIG. 2 is a sectional view of a part of a gas discharge panel according to the invention comprising a display window with grooves, and FIG. 3 is a sectional view of a part of a display window with V-shaped grooves between which are situated cylinder lenses.

FIG. 1 is an elevation, partly broken away, of a flat display tube. Such a display tube is described elaborately in the already mentioned European Patent Application No. 82 20 1405.6 which is not yet laid open to public inspection and the contents of which may be considered to be incorporated in this Application. This tube comprises an envelope 1 which is formed by an optically transparent display window 2, for example of glass, a rear wall 3 and side walls 4 and 5. Two of the side walls are not visible in this Figure. The envelope is divided into a number of modules 6 by means of reinforcement partitions 7 of an electrically insulating material. These partitions support the display window at the rear wall and prevent these from imploding under the influence of atmospheric pressure. An electron gun 8 for generating an electron beam 9 of low beam current and energy is present in each module. The electron beam is deflected by electrodes 10 on the rear wall 3 in such manner that they periodically scan apertures 11 in the channel plate electron multiplier 12. The amplified electron beam emanating from the channel plate electron multiplier 12 is then deflected in the horizontal direction by means of deflection electrodes 13 provided on the reinforcement partitions 7, and a part of the display screen 16 is provided on the inside of the display window being scanned in each module, as seen in FIG. 1*a*. The narrow contact surfaces 14 of the reinforcement partitions and the display window are denoted by broken lines. In order to make these reinforcement partitions less visible, the display window is provided with V-shaped grooves 15. The light (arrows) generated by the electron beam 9 in the display screen 16 consisting, for example, of a phosphor layer, also emanates from the groove 15 opposite from the reinforcement partitions 7 to the display window 2, so that the partitions become substantially invisible.

FIG. 2 is a sectional view of a part of a gas discharge panel. The envelope of the panel is formed by a rear plate 20 which is provided with wedge-like, electrically non-conductive reinforcement partitions 21 on which the display window 22 is supported. Cathodes 23 are present on the rear plate, and the display window comprises one or more transparent anodes 24 on its inside. The discharge space 25 is filled with neon, krypton or a mixture of these rare gases. A glow discharge occurs in the discharge space between the electrodes by applying suitable voltages at the anodes and cathodes. The light of the glow discharges emanates through the display window. By providing the display window with V-shaped grooves 27 opposite to the contact surface of the reinforcement partitions 21 to the display window 22, light (arrows) also emanates from these grooves from the display window, and a continuous picture is obtained in which the reinforcement partitions are substantially no longer visible.

If the edges 28 and 29 of the V-shaped grooves are rounded off and the display window surface 31 between two juxtaposed grooves is curved convex, as is shown in the sectional view of a part of a display window shown in FIG. 3, cylinder lenses 30 are formed between the grooves as a result of which an even more uniform brightness over the surface of the display window is obtained.

What is claimed is:

1. A display panel comprising an envelope having a display window, a plurality of separated reinforcement partitions extending transversely to said display window, said reinforcement partitions being within said envelope, and a plurality of V-shaped grooves on an exterior surface of said display window with one of said plurality of V-shaped grooves being opposite to each of said plurality of separated reinforcement partitions to therefore render reinforcement partitions invisible.

2. A display panel according to claim 1, wherein outermost edges of said V-shaped grooves are rounded off.

3. A display patent according to claim 2, wherein said display window is convexly curved between adjacent grooves.

* * * * *